US007669997B2

(12) United States Patent
Morimoto

(10) Patent No.: US 7,669,997 B2
(45) Date of Patent: Mar. 2, 2010

(54) INK-JET TEXTILE PRINTING METHOD

(75) Inventor: Hitoshi Morimoto, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 476 days.

(21) Appl. No.: 11/255,672

(22) Filed: Oct. 20, 2005

(65) Prior Publication Data

US 2006/0087540 A1 Apr. 27, 2006

(30) Foreign Application Priority Data

Oct. 27, 2004 (JP) ..... 2004-312132

(51) Int. Cl.
*C09D 11/00* (2006.01)

(52) U.S. Cl. ..... 347/100; 106/31.13

(58) Field of Classification Search ..... 347/100; 106/31.13

See application file for complete search history.

(56) References Cited

U.S. PATENT DOCUMENTS

| | | | | |
|---|---|---|---|---|
| 5,540,764 | A | 7/1996 | Haruta et al. | |
| 5,764,261 | A * | 6/1998 | Koike et al. | 347/100 |
| 5,910,812 | A | 6/1999 | Yamamoto et al. | |
| 6,022,908 | A * | 2/2000 | Ma et al. | 523/160 |
| 6,036,307 | A * | 3/2000 | Hakamada et al. | 347/106 |
| 6,344,497 | B1 | 2/2002 | Meyrick et al. | |
| 6,602,333 | B2 * | 8/2003 | Miyabayashi | 106/31.27 |
| 6,733,113 | B2 * | 5/2004 | Yoshizawa et al. | 347/68 |
| 2003/0064206 | A1 * | 4/2003 | Koyano et al. | 428/195 |
| 2004/0201660 | A1 * | 10/2004 | Nishikawa et al. | 347/100 |

FOREIGN PATENT DOCUMENTS

| | | | |
|---|---|---|---|
| JP | 05-295675 | A | 11/1993 |
| JP | 10-114866 | A | 5/1998 |

OTHER PUBLICATIONS

The Merk Index, 1989, p. 1553.
Technical Report Beta-Naphthalenesulfonic Acid-Formaldehyde Condensate, W. K. Smothers Report, p. 1.
CRC Handbook of Chemistry and Physics, 69th Edition, 1988-1989, W. K. Smothers, p. 2-5.
Acrylic Acid, Wikipedia, p. 1.
Fumaric Acid, Wikipedia, p. 1-2.
Understanding Digital Textile Inks, International Dyer, pp. 1-3.
AATCC Technical Manual, 2002, American Association of Textile Chemists and Colorists, pp. 1-10.

* cited by examiner

*Primary Examiner*—Manish S Shah
*Assistant Examiner*—Laura E Martin
(74) *Attorney, Agent, or Firm*—Frishauf, Holtz, Goodman & Chick, P.C.

(57) ABSTRACT

A method of forming an ink-jet image containing the steps of: applying a pre-treatment solution to a textile; and ejecting droplets of an ink-jet ink on the textile through an ink-jet head, wherein the ink-jet ink includes a disperse dye, a dispersing agent, water and a water-soluble organic solvent; the pre-treatment solution comprises an organic acid; and a pH value of the pre-treatment solution is smaller than a pH value of the ink-jet ink.

9 Claims, No Drawings

INK-JET TEXTILE PRINTING METHOD

This application is based on Japanese Patent Application No. 2004-312132 filed on Oct. 27, 2004, in Japanese Patent Office, the entire content of which is hereby incorporated by reference.

TECHNICAL FIELD

The present invention relates to a novel ink-jet textile printing method.

BACKGROUND

An image printing method employing an ink-jet system is a method to print in such a manner that minute ink droplets are jetted from ink-jet recording heads to adhere to targeted recording media. Ink-jet systems exhibit advantages since its mechanism is relatively simple and less expensive in cost and further, it is possible to form highly detailed and high quality images.

By utilizing the above advantages of the ink-jet systems, developed has been image printing onto textiles, so-called ink-jet textile printing. The ink-jet textile printing, differing from conventional textile printing, does not require formation of plates and exhibits features such as quick formation of images of excellent gradation. In addition, the ink-jet textile printing method may be described as an excellent image forming method which also exhibits environmental protection such as minimal liquid waste compared to conventional methods since only enough ink is consumed to form the image.

Generally, in the dyeing industry, a large amount of water is consumed in each process, and as a result, a large amount of effluent is discharged. For the disposal and treatment of the above effluent, a great expense is incurred and it is essential to secure a steady and high volume of water resources. Consequently, demanded has been an ink-jet textile printing method capable of reducing the load for the treatment and disposal of the effluent, namely an ink jet textile printing method which exhibits excellent washing properties.

Particularly, in the case of hydrophobic synthetic fibers such as polyester, commonly is performed dyeing employing water-insoluble disperse dyes. In disperse dye ink which is prepared by dispersing disperse dyes together with dispersing agents, in order to remove the dispersing agents which are unnecessary after color development as well as disperse dyes which are not fixed onto the fibers, a washing process is required. Washing properties during the above washing process include the following; unnecessary components (such as pastes or dispersing agents) for final products, which are incorporated in ink or pre-treatment materials are easily removed, the amount of sludge is as small as possible, or components which result in stain of dyed products are easily removed.

In the ink-jet system, since the viscosity of employed inks is lower than that of color pastes employed in conventional textile dyeing, it is necessary to minimize ink bleeding on the textile, whereby the resulting washing properties are greatly influenced by the bleeding resistant methods.

For example, proposed is a textile dyeing method in which a pretreatment is performed employing pastes, water-soluble salts, or minute inorganic particles (refer, for example, to Patent Document 1). In the above method, a large amount of sludge is formed during washing. As a result, it is accepted fact that washing capability is not satisfactory.

Further, disclosed are a method in which the effluent treating load is lowered by controlling the moisture content of textiles to enhance the degree of exhaustion (refer, for example, to Patent Document 2) and a method in which washing is omitted or shortened by employing specific dispersing agents (refer, for example to Patent Document 3). However, any of these proposed methods do not thoroughly improve the washing properties, and the resulting effects are limited.

In view of the foregoing, demanded has been development of ink-jet textile printing methods which result in no formation of sludge and exhibits excellent washing properties.

(Patent Document 1) Japanese Patent Publication for Public Inspection (hereinafter referred to as JP-A) No. 61-55277

(Patent Document 2) JP-A No. 5-295675

(Patent Document 3) JP-A No. 10-114866

SUMMARY

In view of the above concerns, the present invention was achieved. An object of the present invention is to provide an ink-jet textile printing method employing disperse dyes which result in no sludge and exhibit excellent washing properties.

The above object of the present invention is achievable employing the following embodiments.

(1) An embodiment of the present invention includes a method of forming an ink-jet image comprising the steps of:

applying a pre-treatment solution to a textile; and ejecting droplets of an ink-jet ink on the textile through an ink-jet head, wherein the ink-jet ink comprises a disperse dye, a dispersing agent, water and a water-soluble organic solvent; the pre-treatment solution comprises an organic acid; and a pH value of the pre-treatment solution is smaller than a pH value of the ink-jet ink.

(2) Another embodiment of the present invention includes a method of forming an ink-jet image of the above-described item 1, wherein the pH value of the ink-jet ink is larger than a pKa value of the dispersing agent.

(3) Another embodiment of the present invention includes a method of forming an ink-jet image of any one of the above-described items 1 and 2, wherein the dispersing agent has a carboxyl group in the molecule.

(4) Another embodiment of the present invention includes a method of forming an ink-jet image of any one of the above-described items 1 to 3, wherein a molar ratio of the carboxyl group is not less than 50 mol % based on the total mol number of acid dissociation groups in the dispersing agent.

(5) Another embodiment of the present invention includes a method of forming an ink-jet image of any one of the above-described items 1 to 3, wherein a molar ratio of the carboxyl group is not less than 80 mol % based on the total mol number of acid dissociation groups in the dispersing agent.

(6) Another embodiment of the present invention includes a method of forming an ink-jet image of the above-described item 1, wherein the pH value of the pre-treatment solution is smaller than a pKa value of the organic acid.

(7) Another embodiment of the present invention includes a method of forming an ink-jet image of any one of the above-described items 1, wherein the pKa value of the organic acid is smaller than the pH value of the ink-jet ink.

(8) Another embodiment of the present invention includes a method of forming an ink-jet image of any one of the above-described items 1, wherein the pKa value of the organic acid is smaller than a pKa value of the dispersing agent in the ink-jet ink.

(9) Another embodiment of the present invention includes a method of forming an ink-jet image of any one of the above-described items 1, wherein the organic acid is selected from the group consisting of tartaric acid, citric acid and lactic acid.

(10) Another embodiment of the present invention includes a method of forming an ink-jet image of any one of the above-described items 1 to 9, further comprising the step of:

washing the textile with a washing solution after the ejecting step of the droplets of the ink-jet ink, wherein a pH value of the washing solution is larger than the pH value of the pre-treatment solution.

(11) Another embodiment of the present invention includes a method of forming an ink-jet image of any one of the above-described items 1 to 10, wherein the disperse dye has a melting point of not more than 200° C.

(12) Another embodiment of the present invention includes a method of forming an ink-jet image of any one of the above-described items 1 to 11, wherein the applying step of the pre-treatment solution is carried out using an ink-jet head.

Based on the present invention, it is possible to provide an ink-jet textile printing method which results in no sludge and exhibits excellent washing properties.

DESCRIPTION OF THE PREFERRED EMBODIMENTS

The preferred embodiments to practice the present invention will now be detailed.

In view of the aforesaid concerns, the inventors of the present invention conducted diligent investigation and discovered the following, resulting in the present invention. In an ink-jet textile printing method in which ink, which incorporates at least a disperse dye, a dispersing agent, water, and a water-soluble organic solvent, is employed, and then recording is performed on textile by ejecting the above ink, it was possible to realize the ink-jet textile printing method employing disperse dyes which result in no sludge and exhibit excellent washing properties employing an ink-jet textile printing method which is characterized in that prior to depositing the above ink onto the above textile, a pre-treatment solution at a pH lower than that of the above ink is applied to the above textile.

Namely, prior to providing textile with the ink which is prepared by dispersing disperse dyes as a colorant into an aqueous medium, by providing textile with liquid which is more acidic than the ink, dispersing agents, which were employed for dispersion in the ink deposited on the textile, were subjected to a high rate of coagulation, whereby it was possible to fix the disperse dye. It was discovered that the above fixing method made it possible to realize rapid washing in the washing process after color development and further, the formation of sludge was extremely small.

Further, it was discovered that in cases in which disperse dyes at a melting point of at most 200° C. were employed, it was possible to obtain prints of high density and high color development efficiency.

The present invention will now be detailed.

In ink-jet textile printing methods, commonly, printing on textile is accomplished employing processes such as: pre-treatment process in which to minimize bleeding, a pretreatment solution is applied onto textile employing a pad method, a coating method, or a spraying method; subsequently an ink providing process in which images are formed on textiles which are constituted employing fibers capable of being dyed with colorants, employing an ink jet recording system employing an ink; a color development process in which the textile provided with ink is subjected to heat treatment; and a washing process in which the heat-treated textile is washed, whereby printed textile products are obtained.

The ink-jet textile printing method of the present invention is characterized in that prior to providing textile with an ink incorporating disperse dyes, dispersing agents, water and water-soluble organic solvents, the above textile is provided with a pretreatment solution at a pH lower than the ink.

Initially detailed will be the ink constitution according to the present invention.

The ink according to the present invention is composed mainly of disperse dyes, dispersing agents, water, and water-soluble organic solvents.

One of the features of the ink according to the present invention is that disperse dyes are employed as a colorant. The disperse dyes are nonionic dyes, having no ionic water-solubilizing group, such as a sulfone group or a carboxyl group and exhibit minimal solubility to water. Consequently, they are commonly dispersed into water in the form of minute powder, employing dispersing agents and can be employed to dye synthetic fibers. Being different from pigments, they are soluble in organic solvents such as acetone or dimethylformamide, whereby it is possible to conduct coloration by diffusing them into synthetic fibers at the molecular level.

Further, in order to dye textiles composed of a plurality of fiber types produced by blended spinning or combined weave, in the ink according to the present invention, dyes other than the disperse dyes, such as acid dyes or direct dyes are blended and used.

Specific compounds of disperse dyes preferred for the present invention are shown below; however, the presented invention is not limited to the exemplified compounds.

C. I. Disperse Yellow; 3, 4, 5, 7, 9, 13, 23, 24, 30, 33, 34, 42, 44, 49, 50, 51, 54, 56, 58, 60, 63, 64, 66, 68, 71, 74, 76, 79, 82, 83, 85, 86, 88, 90, 91, 93, 98, 99, 100, 104, 108, 114, 116, 118, 119, 122, 124, 126, 135, 140, 141, 149, 160, 162, 163, 164, 165, 179, 180, 182, 183, 184, 186, 192, 198, 199, 202, 204, 210, 211, 215, 216, 218, 224, 227, 231, 232, C. I. Disperse Orange; 1, 3, 5, 7, 11, 13, 17, 20, 21, 25, 29, 30, 31, 32, 33, 37, 38, 42, 43, 44, 45, 46, 47, 48, 49, 50, 53, 54, 55, 56, 57, 58, 59, 61, 66, 71, 73, 76, 78, 80, 89, 90, 91, 93, 96, 97, 119, 127, 130, 139, 142, C. I. Disperse Red; 1, 4, 5, 7, 11, 12, 13, 15, 17, 27, 43, 44, 50, 52, 53, 54, 55, 56, 58, 59, 60, 65, 72, 73, 74, 75, 76, 78, 81, 82, 86, 88, 90, 91, 92, 93, 96, 103, 105, 106, 107, 108, 110, 111, 113, 117, 118, 121, 122, 126, 127, 128, 131, 132, 134, 135, 137, 143, 145, 146, 151, 152, 153, 154, 157, 159, 164, 167, 169, 177, 179, 181, 183, 184, 185, 188, 189, 190, 191, 192, 200, 201, 202, 203, 205, 206, 207, 210, 221, 224, 225, 227, 229, 239, 240, 257, 258, 277, 278, 279, 281, 288, 298, 302, 303, 310, 311, 312, 320, 324, 328, C. I. Disperse Violet; 1, 4, 8, 23, 26, 27, 28, 31, 33, 35, 36, 38, 40, 43, 46, 48, 50, 51, 52, 56, 57, 59, 61, 63, 69, 77, C. I. Disperse Green; 9, C. I. Disperse Brown; 1, 2, 4, 9, 13, 19, C. I. Disperse Blue; 3, 7, 9, 14, 16, 19, 20, 26, 27, 35, 43, 44, 54, 55, 56, 58, 60, 62, 64, 71, 72, 73, 75, 79, 81, 82, 83, 87, 91, 93, 94, 95, 96, 102, 106, 108, 112, 113, 115, 118, 120, 122, 125, 128, 130, 139, 141, 142, 143, 146, 148, 149, 153, 154, 158, 165, 167, 171, 173, 174, 176, 181, 183, 185, 186, 187, 189, 197, 198, 200, 201, 205, 207, 211, 214, 224, 225, 257, 259, 267, 268, 270, 284, 285, 287, 288, 291, 293, 295, 297, 301, 315, 330, 333, C. I. Disperse Black; 1, 3, 10, 24.

In view of allowing the targeted effects of the present invention to more exhibit, the melting point of the disperse dyes according to the present invention is preferably at most 200° C., but is more preferably 150-200° C. Further, in the ink-jet textile printing method, in the case of color development employing a high temperature treatment, it is preferable to select disperse dyes which exhibit high sublimation resistance.

It is possible to prepare the ink according to the present invention by blending dispersing agents, humectants, media, and optional additives together with water-insoluble disperse dyes and dispersing the resulting mixture employing a homogenizer. Employed as homogenizers may be a ball mill, a sand mill, a line mill, or a high pressure homogenizer, which are conventionally used in the prior art.

The average diameter of disperse dye particles is preferably at most 300 nm and the maximum particle diameter is preferably at most 900 nm. When the average particle diameter and maximum particle diameter each exceed the above range, in an ink-jet textile printing method in which ejection is conducted from minute nozzles, clogging tends to occur, whereby it is not possible to perform stable ejection. Incidentally, it is possible to determine the average particle diameter employing commercially available particle size measurement instruments employing a light scattering method, an electrophoretic method, or a laser Doppler method. Listed as a specific particle size measurement instrument may, for example, be ZETER SIZER 1000, produced by Malvern Inc.

The content of disperse dyes in the ink according to the present invention is preferably 0.1-20 percent by weight, but is more preferably 0.2-13 percent by weight. It is possible to employ commercially available disperse dyes without any treatment, but it is preferable to employ them after subjecting them to a purification treatment. Employed as such a purification method may be a recrystallization method and a washing method known in the prior art. It is preferable that suitable organic solvents employed for the purification method and purification treatment are selected depending on the type of dyes.

Dispersing agents according to the present will now be described.

Listed as dispersing agents usable in the ink according to the present invention may be polymer dispersing agents and low molecular weight surface active agents. Of these, in view of storage stability of the ink, it is preferable to use polymer dispersing agents.

Listed as polymer dispersing agents are, for example, natural rubber such as gum Arabic or tragacanth gum; glucoxides such as saponin; cellulose derivatives such as methyl cellulose, carboxy cellulose, or hydroxymethyl cellulose; natural polymers such as lignosulfonic acid salts or shellac; anionic polymers such as polyacrylic acid salts, salts of styrene-acrylic acid copolymers, salts of vinylnaphthalene-maleic acid copolymers, sodium salts or phosphates of β-naphthalenesulfonic acid formalin condensation products; and nonionic polymers such as polyvinyl alcohol, polyvinylpyrrolidone, or polyethylene glycol.

Further, listed as examples of low molecular weight surface active agents are anionic surface active agents such as fatty acid salts, higher alcohol sulfuric acid ester salts, liquid fatty acid sulfuric acid ester salts and nonionic surface active agents such as polyoxyethylene alkyl ethers, sorbitan alkyl esters, or polyoxyethylene sorbitan alkyl esters. These compounds may be employed individually or in combinations of at least two types which are appropriately selected. The used amount is preferably in the range of 1-20 percent by weight with respect to the total ink weight.

Dispersing agents according to the present invention are preferably those having a carboxyl group, which are available as commercial products. Examples include polymer dispersing agents such as lignosulfonic acid salts (for example, VANILEX RN, produced by Nippon Paper Industries Co., Ltd.), copolymers of α-olefin and maleic anhydride (for example, FLORENE G-700, produced by KYOEISHA Chemical Co., Ltd.) or SUN EKISU (produced by Nippon Paper Industries Co., Ltd.).

The used amount of dispersing agents such as polymer dispersing agents according to the present invention is preferably 20-200 percent with respect to the disperse dyes. When the amount of the dispersing agents is small, disperse dyes do not result in formation of minute particles, resulting in insufficient dispersion stability. On the other hand, the excessively large content of the dispersing agents is not preferred due to the following reasons. The formation of minute particles and dispersion stability are degraded, whereby ink viscosity increases. These dispersing agents may be employed individually or in combination.

In the dispersing agents according to the present invention, the ratio of the mol number of the carboxylic group to the mol number of the total acidic dissociating group incorporated in the above dispersing agents is preferably at least 50 mol percent, is more preferably at least 80 mol percent, but is still more preferably 80-100 mol percent. By employing the dispersing agents at the mol number ratio of a carboxylic group as specified above, it is possible to further exhibit the targeted effects of the present invention.

The acidic dissociating group incorporated in the dispersing agent, as described in the present invention, is also called a proton dissociating group. Listed as examples of such proton dissociating groups may be a carboxyl group, a sulfato group, a phosphono group, an alkylsulfonylcarbamoyl group, an acylcarbamoyl group, an acylsulfamoyl group, and an alkylsulfonylsulfamoyl group.

In the ink according to the present invention, it is preferable that the pH of the ink is higher than the pKa of the main acidic dissociating group of the above dispersing agents. By regulating the pH of the ink and the pKa of the acidic dissociating group of the dispersing agent to satisfy the above relationship, it is possible to effectively fix disperse dyes in the ink onto textiles. Incidentally, the main acidic dissociating group of the dispersing agent, as described in the present invention, refers to the acidic dissociating group at a mol percent of at least 50 mol percent.

The pKa value, as described in the present invention, is also called an acid dissociation constant, which is detailed, for example, in Buichi Sakaguchi and Keihei Ueno, Kinzoku Chelates [III] (Metal Chelates [III]), Nanko Do, which describes pKa values of acidic dissociating groups. Further, it is possible to determine the pKa of compounds, which are not described in the above reference, employing conventional methods. For example, it is possible to determine the pKa employing the method described, for example, in Jikken Kagaku Koza 5 Netsuteki Sokutei oyobi Heiko (Experimental Chemistry Lecture 5 Thermal Measurements and Equilibrium) page 460, edited by Nihon Kagaku Kai, Maruzen Co., Ltd.

Water-soluble solvents according to the present invention will now be described.

Listed as water-soluble organic solvents usable in the present invention are, for example, polyhydric alcohols (for example, ethylene glycol, glycerin, 2-ethyl-2-(hydroxymethyl)-1,3-propanediol, tetraethylene glycol, triethylene glycol, tripropylene glycol, 1,2,4-butanetriol, ethylene glycol, propylene glycol, dipropylene glycol, butylene glycol, 1,6-hexanediol, 1,2-hexanediol, 1,5-pentanediol, 1,2-pentanediol, 2,2-dimethyl-1,3-propanediol, 2-methyl-2,4-pentanediol, 3-methyl-1,5-pentanediol, 3-methyl-1,3-butanediol, and 2-methyl-1,3-propanediol); amines (for example, ethanolamine and 2-(dimethylamino)ethanol); monohydric alcohols (for example, methanol, ethanol, and butanol); alkyl ethers of polyhydric alcohols (for example, diethylene glycol monomethyl ether, diethylene glycol monobutyl ether, triethylene glycol monomethyl ether, triethylene glycol monobutyl ether, ethylene glycol monomethyl ether, ethylene glycol monobutyl ether, propylene glycol monomethyl ether, propylene glycol monobutyl ether, and dipropylene glycol monomethyl ether); 2,2'-thiodiethanol; amides (for example, N,N-dimethylformamide); heterocycles (2-pyrrolidone); and acetonitrile. The volume of water-soluble organic solvents is preferably 10-60 percent by weight with respect to the total ink weight.

In order to stably maintain ink viscosity and disperse dyes, and to improve color development, added to the ink according to the present invention may be inorganic salts other than the constituting components described above. Listed as inorganic salts are, for example, sodium chloride, sodium sulfate, magnesium chloride, and magnesium sulfide. Further, in order to maintain storage stability of ink over an extended period of time, it is possible to incorporate antifungal agents and antiseptics into the ink. Listed as antiseptics and antifungal agents are aromatic halogen compounds (for example, PREVENTOL CMK), methylene dithiocyanate, halogen containing nitrogen sulfur compounds, and 1,2-benzisothiazoline-3-one (for example, PROXEL GXL), however, the present invention is not limited thereto.

Further, it is preferable that dyeing assistant auxiliaries are incorporated in the textile printing ink-jet ink employed during dyeing, employing a high temperature steaming method, or textiles employed for textile printing. During steaming of printing textile, dyeing assistant auxiliaries form a eutectic mixture with condensed water in the form of the textile pattern and function to limit the re-vaporized water amount and shorten the temperature rising time. Further, the resulting eutectic mixture dissolves dyes in fibers and enhances the rate of diffusion of dyes into the fibers. Listed as a dyeing assistant auxiliary is urea.

In the ink according to the present invention, during textile printing employing an ink-jet printer, dissolved gases incorporated in the ink result in degradation of resolution and definition, or result in formation of microscopic air bubbles. Consequently, it is preferable to remove such dissolved gases in the ink. Degassing methods are divided mainly into a method in which degassing is conducted employing physical methods such as boiling or reduced pressure and a chemical method in which absorbing agents are added to the ink and mixed. In the present invention, it is possible to perform degassing employing any method. However, the following method is particularly preferred which is capable of efficiently removing dissolved gases in the ink without adversely affecting the physical properties of the ink. By reducing pressure of the exterior surface of a hollow fiber membrane, dissolved gases in the ink are transmitted through and thereby removed.

A pretreatment solution according to the present invention will now be described.

The pretreatment solution according to the present invention is characterized in that it is applied to textiles before ink is applied and its pH is lower than that of the ink.

Methods in which the pH of the above pretreatment solution is controlled to the above condition specified in the present invention are not particularly limited. It is possible to use pH controlling additives such as various types of inorganic and organic acids. Listed as inorganic acids are acetic acid, hydrochloric acid, sulfuric acid, chlorous acid, nitric acid, nitrous acid, sulfurous acid, phosphorous acid, phosphoric acid, chloric acid and hypophosphorous acid.

In the present invention, it is preferable to regulate the pH of the pretreatment solution to the desired pH employing organic acids. Listed as organic acid usable in the present invention are formic acid, acetic acid, propionic acid, butyric acid, isobutyric acid, valeric acid, isovaleric acid, oxalic acid, malonic acid, succinic acid, glutaric acid, maleic acid, fumaric acid, citraconic acid, itaconic acid, tricarballylic acid, glycolic acid, thioglycolic acid, lactic acid, malic acid, tartaric acid, citric acid, isocitric acid, gluconic acid, pyruvic acid, oxalacetic acid, diglycolic acid, benzoic acid, phthalic acid, mandelic acid, and salicylic acid. Of these, the organic acid is more preferably at least one selected from the group consisting of tartaric acid, citric acid, and lactic acid.

In the ink-jet textile printing method of the present invention, it is preferred that 1) the pH of the pretreatment solution is set to be lower than the pKa of organic acids, 2) organic acids are selected which exhibit a pH which is lower than that of the ink and a pKa value which is equal to or higher than the pretreatment solution, or 3) organic acids are selected which exhibit a pKa value which is lower than the pKa of a dispersing agent while being equal to or higher than the pH of the pretreatment solution. Before the ink is applied to textiles, by applying, to textiles, the pretreatment solution, being more acidic than the ink, which incorporates organic acids which meet the conditions specified as above, it is possible to coagulate at a high rate, the dispersing agents which have been employed to disperse dyes in the ink deposited onto textiles, whereby it is possible to efficiently fix disperse dyes.

In the ink-jet textile printing method of the present invention, it is possible to apply the pretreatment solution according to the present invention to textiles employing conventional application methods, known in the prior art, such as a pad method, a coating method, or a spray method. In the present invention, from the viewpoint of being capable of applying the pretreatment solution to optional portions of the textile, a method is preferred in which the pretreatment solution is applied onto the textile employing ink-jet heads.

In the ink-jet textile printing method of the present invention, textile printing is conducted employing a pretreatment process in which a pretreatment solution is applied onto textiles as described above, an ink providing process, as the following process, whereby recording is performed on textiles by ejecting ink from ink-jet heads, a color development process in which the ink-provided textile is subjected to a heat treatment, and further a washing process in which the heat-treated textile is washed.

In the ink-jet textile printing, when the ink-printed textile is allowed to stand without any post-treatment, dyeing is not desirably achieved. In cases in which long-length of textile is continuously printed over an extended period of time, printed textile is continuously produced. When the printed textile is not adequately processed, it will pile up or take room, whereby safety is not secured and unexpectedly, it may occasionally be stained. Due to that, a winding operation is required. During this operation, media such as paper, cloth, or vinyl sheets which do not adversely affect printing may be placed between layers of textile. However, in cases in which the printed textile is cut on the way or is short in length, it is unnecessary to perform winding.

The color development process, as described herein, refers to a process in which the original hue of dyes in an ink, which is merely adhered onto the surface of textile after printing and is neither sufficiently adsorbed nor fixed, is adsorbed and fixed. Employed as methods are steaming employing steam, dry heat baking, thermosol, HT steamer utilizing superheated steam, and HP steamer utilizing pressurized steam. These are suitably selected depending on printing components and inks. Further, printed textiles may be subjected to drying and a color development treatment corresponding to its intended use in such a manner that the heating treatment is performed immediately after printing or some time after printing. In the present invention, any of the above methods may be employed.

During dyeing employing disperse dyes, other than the method in which color development is performed at high temperature, a method may be employed in which carriers are used. Compounds preferably employed as carriers are those exhibiting features such as high dyeing enhancement, a simple using method, stability, minimal adverse effects to humans and to the environments, easy removal from fibers, and no adverse effects on dyeing durability. Listed as examples of such carriers may be phenols such as o-phenylphenol, p-phenylphenol, methylnaphthalene, alkyl benzoate, alkyl salicylate, chlorobenzene, or diphenyl; as well as ethers, organic acids, and hydrocarbons. These compounds accelerate swelling and plasticization of fibers such as polyester, which exhibits difficulty of dyeing at approximately 100° C., whereby the disperse dyes tend to enter into fibers. The carriers may previously be adsorbed onto the fibers of textile employed for ink-jet printing, or may be incorporated in an ink-jet ink.

Further, it is preferable that dyeing assistant auxiliaries are incorporated in a textile printing ink-jet ink which is employed during a high temperature steaming method, or textiles which are employed in textile printing. During steaming of the printing textile, the dyeing assistant auxiliaries form a eutectic mixture with condensed water in the form of the textile pattern and function to limit the re-vaporized water amount, and shorten the temperature raising time. Further, the resulting eutectic mixture dissolves dyes on fibers and enhances the rate of diffusion of dyes into the fibers. Listed as a dyeing assistant auxiliary is urea.

After the heat treatment, a washing process is required because the residual dyes, which have not participated in the dyeing, degrade stability of the resulting color and durability. Further, it is necessary to remove materials employed for the pretreatment. When they are not removed, the resulting durability is degraded and textiles are subjected to discoloration. Due to that, washing, based on materials to be removed and purposes, is essential. Methods are selected based on printing components and inks. For example, in the case of polyester, a treatment is commonly performed employing a mixed solution of sodium hydroxide, surface active agents, and hydrosulfite. The treatment is performed employing a method in which continuous type devices such as an open soaper is used or batch type devices such as a jet dyeing machine is used. In the present invention, either method may be employed.

Drying is needed after washing. After squeezing or dehydrating the washed textile, drying is performed employing hangers, dryers, heating rollers, or irons.

Components which constitute textiles employed in the ink-jet textile printing method of the present invention are not particularly limited as long as they incorporate fibers capable of being dyed employing disperse dyes. Of these, preferred are those incorporating polyester, acetate or triacetate fibers. Of these, particularly preferred are textiles incorporating polyester fibers. Textiles may be employed in any form in which fibers are woven, or knitted, or in the form of nonwoven fabric. Further, it is suitable that textiles usable in the present invention are composed of 100 percent of fibers capable of being dyed with disperse dyes, but it is also possible to use blended textiles with rayon, cotton, polyurethane, acryl, nylon, wool and silk or blended nonwoven fabric. Further, the thickness of threads constituting the above textiles is preferably in the range of 10-100 d.

EXAMPLES

The present invention will now be specifically described with reference to examples, but the present invention is not limited thereto. Further, "parts" and "%" which are used in the examples are "parts by weight" and "% by weight", respectively, unless otherwise specified.

Example 1

Preparation of Ink (Preparation of Disperse Dye Dispersions M1-M6)

After successively mixing additives described below, the resulting mixture was dispersed employing a sand grinder, whereby a disperse dye dispersion was prepared. Dispersion was terminated when the average diameter of dispersed disperse dye particles reached 200 nm. Subsequently, the pH was controlled to the value listed in Table 1 by adding the necessary amount of sulfuric acid or sodium hydroxide.

| | |
|---|---|
| Disperse dye (the type described in Table 1) | 25 parts |
| Glycerin | 30 parts |
| Dispersing Agent (the type described in Table 1) | 12 parts |
| Sulfuric acid or sodium hydroxide the necessary amount to control the pH to the desired value | |
| Ion-exchanged water to make | 100 parts |

TABLE 1

| Disperse Dye Dispersion | | Dispersing Agent | | |
|---|---|---|---|---|
| No. | Disperse Dye | Trade Name | Maker | pH |
| M1 | C.I. Disperse Red 302 | FLORENE-700 | KYOEISHA Chemical Co., Ltd. | 8.0 |
| M2 | C.I. Disperse Red 302 | VANILEX RN | Nippon Paper Inquiries Co., Ltd. | 8.0 |
| M3 | C.I. Disperse Red 302 | VANILEX RN | Nippon Paper Inquiries Co., Ltd. | 5.0 |
| M4 | C.I. Disperse Red 302 | VANILEX RN | Nippon Paper Inquiries Co., Ltd. | 5.6 |
| M5 | C.I. Disperse Red 302 | SUN KIESU P252 | Nippon Paper Industries Co., Ltd. | 8.0 |
| M6 | C.I. Disperse Red 302 | DEMOL N | Kao Corp. | 8.0 |

Incidentally, Table 2 shows the mol ratio (in %) of the carboxyl group to the total mol number of the acidic dissociating group of the dispersing agents employed to prepare above Disperse Dye Dispersions M1-M6 and the pKa of main acidic dissociating groups.

TABLE 2

| Name of Dispersing Agent | Mol Ratio of Carboxyl Group (mol %) | pKa |
|---|---|---|
| FLORENE G-700 | 100 | 7.0 |
| VANILEX RN | 67 | 5.5 |
| SUN EKISU P252 | 15 | <2.0 |
| DEMOL N | 0 | <2.0 |

(Preparation of Inks M1-M6)

By employing above Disperse Dye Dispersions M1-M6 prepared as above, Inks M1-M6 were prepared based on the formula below. Subsequently, in the same manner as for preparation of the above disperse dye dispersions, the pH was controlled by the addition of sulfuric acid or sodium hydroxide so that the pH reached the same value as the employed disperse dye dispersion.

Further, filtration was performed employing a 3 μm membrane filter, followed by degassing. Degassing was performed in such a manner that each of the prepared inks was allowed to pass through a gas permeable hollow yarn membrane (produced by Mitsubishi Rayon Co., Ltd.) and by reducing pressure on the exterior surface of the hollow yarn membrane, employing a tap aspirator, gases dissolved in the ink were removed. Further, after degassing, the resulting ink was subjected to vacuum packing to prevent it from mixing with ambient air.

| | |
|---|---|
| Disperse dye dispersion | 40 parts |
| Ethylene glycol | 20 parts |
| Glycerin | 10 parts |

-continued

| | |
|---|---|
| Sodium diethylhexylsulfosuccinate | 0.5 part |
| PROXEL GXL (produced by AVECIA Co.) | 0.1 part |
| Sulfuric acid or sodium hydroxide | necessary amount |
| Ion-exchanged water to make | 100 parts |

Preparation of Pretreatment Solution

The additives described below were successively added and dissolved, whereby the pretreatment solutions described in Table 3 were prepared. Further, the pH of some of the pretreatment solutions was controlled employing sodium hydroxide to reach the value described in Table 3.

Subsequently, filtration was performed employing a 3 μm membrane filter, followed by degassing. Degassing was performed in such a manner that each of the pretreatment solutions was allowed to pass through a gas permeable hollow yarn membrane (produced by Mitsubishi Rayon Co., Ltd.) and by reducing pressure on the exterior surface of the hollow yarn membrane, employing a tap aspirator, gases dissolved in the pretreatment solution were removed. Further, after degassing, the resulting pretreatment solution was subjected to vacuum packing to prevent it from mixing with ambient air.

| | |
|---|---|
| Ethylene glycol | 20 parts |
| Glycerin | 10 parts |
| Acid | the amount described in Table 3 |
| Sodium diethylhexylsulfosuccinate | 0.5 part |
| PROXEL GXL (produced by AVECIA Co.) | 0.1 part |
| Ion-exchanged water to make | 100 parts |

Incidentally, in Table 3, in regard to acids having a plurality of pKa values of the acidic dissociating group, all values are listed.

TABLE 3

| Pretreatment Solution No. | Acid Type | Added Amount (parts) | pH | pKa |
|---|---|---|---|---|
| 1 | sulfuric acid | 1 | <1.0 | <2.0 |
| 2 | citric acid | 5 | 4.0 | 3.1, 4.8, 6.4 |
| 3 | tartaric acid | 5 | 4.0 | 3.0, 5.1 |
| 4 | maleic acid | 5 | 4.0 | <2.0, 5.8 |
| 5 | maleic acid | 5 | 5.0 | <2.0, 5.8 |
| 6 | maleic acid | 5 | 5.6 | <2.0, 5.8 |
| 7 | phosphoric acid | 1 | 9.0 | 2.1, 7.2, 11.8 |

Image Printing (Preparation of Evaluation Samples A1-A6 and B1-B7)

Each ink and each pretreatment solution prepared as above were combined as listed in Table 4 and ejected onto a textile employing the ink-jet printer described below, whereby Evaluation Samples A1-A6 and B1-B7 were prepared.

Evaluation images were printed, at 25° C. and 50 percent relative humidity, on a polyester de Chine cloth produced by each dyeing company as a textile, employing an ink-jet printer loaded with the head unit composed of one piezo head for the pretreatment solution and four piezo heads for each ink at a driving frequency of 20 kHz and a nozzle diameter of 30 micrometer, which was controlled to achieve a rate of ink droplets of each color of 6 m/second, so that the pretreatment solution was always deposited on the textile prior to the ink deposition.

Employed as an evaluation image was a color solid image at a resolving power of 720 dpi×720 dpi which was prepared by ejecting 30 percent of the pretreatment solution and 100 percent of the ink in terms of 100 percent when ink droplets were deposited onto all the pixels. Incidentally, dpi, as described in the present invention, represents the number of dots per 2.54 cm.

(Preparation of Evaluation Samples C1-C4)

Evolution Samples C1-C4 composed of solid color images were prepared in such a manner that by employing the same ink-jet printer employed to prepare the above evaluation samples, each of the inks described in Table 4 was ejected onto a pretreated fabric in an amount of 100 percent. Employed as a pretreated fabric was SUMINOE FABRIC GB3951 (de Chine) cloth produced by SUMINOE Co., Ltd.

TABLE 4

| Evaluation Sample No. | Ink No. | Pretreatment Solution No. | Remarks |
|---|---|---|---|
| A1 | M2 | 7 | Comparative Example |
| A2 | M3 | 1 | Present Invention |
| A3 | M6 | 1 | Present Invention |
| A4 | M5 | 1 | Present Invention |
| A5 | M2 | 1 | Present Invention |
| A6 | M1 | 1 | Present Invention |
| B1 | M1 | 3 | Present Invention |
| B2 | M1 | 2 | Present Invention |
| B3 | M2 | 2 | Present Invention |
| B4 | M2 | 4 | Present Invention |
| B5 | M2 | 5 | Present Invention |
| B6 | M4 | 4 | Present Invention |
| B7 | M2 | 6 | Present Invention |
| C1 | M1 | — | Comparative Example |
| C2 | M2 | — | Comparative Example |
| C3 | M5 | — | Comparative Example |
| C4 | M6 | — | Comparative Example |

Color Development

Each of the evaluation samples, prepared as above, was subjected to a heat color development process at 195° C. for one minute, employing a heating roller.

Evaluation of Each Characteristic (Evaluation of Washing Properties)

Washing was performed in such a manner that after Washing Process 1 (the time described in Table 5), dehydration was performed. Employed as the washing solution was a working solution prepared by dissolving HIGH CLEANER CA-10Y, produced by Tokai Seiyu Co. in an amount of 2 g/liter in city water, and the pH of the washing solution was set at 5.0.

During the washing process, after performing Washing Process 1 for 10 minutes and for an additional 20 minutes, dehydration was performed. Subsequently, Washing Time 2 was conducted for 60 minutes.

At each level, after performing Washing Process 1 for 5 minutes, for 10 minutes, and for 20 minutes, respectively, each washing solution was sampled and dyes incorporated in the washing solution were extracted employing ethyl acetate. Thereafter, the spectral absorption curve in the UV-Vis wave form of the extract was determined employing a spectrophotometer UVIDFC-610, produced by Shimadzu Corp., and the wavelengths due to disperse dyes and each absorbance were determined. When absorbance during 20 minutes of the washing time in Washing Process 1 was 100, the relative absorbance value of washing time of 5 minutes and 10 minutes in Washing Process 1 was employed as an index of washing properties. When the value approached 100, washing properties (capability of removing disperse dyes which were not employed for dyeing) were further improved. As sooner the value approached 100, the washing rate was higher.

(Evaluation of Sludge Forming Resistance)

On the above washing process, after performing Washing Process 1 for 20 minutes, the resulting was sampled and dried employing heated air flow. Thereafter, the residue was visually observed.

Table 5 shows the results.

TABLE 5

| Evaluation | Relative Absorbance Washing Time of Washing Process 1 | | | Sludge | |
|---|---|---|---|---|---|
| Sample No. | 5 minutes | 10 minutes | 20 minutes | Forming Resistance | Remarks |
| A1 | 30 | 55 | 100 | relatively small | Comparative Example |
| A2 | 50 | 80 | 100 | small | Present Invention |
| A3 | 65 | 85 | 100 | small | Present Invention |
| A4 | 70 | 90 | 100 | small | Present Invention |
| A5 | 75 | 95 | 100 | small | Present Invention |
| A6 | 80 | 100 | 100 | small | Present Invention |
| B1 | 95 | 100 | 100 | small | Present Invention |
| B2 | 95 | 100 | 100 | small | Present Invention |
| B3 | 90 | 100 | 100 | small | Present Invention |
| B4 | 85 | 98 | 100 | small | Present Invention |
| B5 | 80 | 97 | 100 | small | Present Invention |
| B6 | 75 | 95 | 100 | small | Present Invention |
| B7 | 70 | 90 | 100 | small | Present Invention |
| C1 | 30 | 60 | 100 | large | Comparative Example |
| C2 | 40 | 65 | 100 | large | Comparative Example |
| C3 | 35 | 62 | 100 | large | Comparative Example |
| C4 | 45 | 67 | 100 | large | Comparative Example |

As can clearly be seen from the results in Table 5, the evaluation samples of the present invention, which were prepared by applying to textiles the pretreatment solution at a pH lower than the ink, prior to applying the ink to the textiles, exhibited the following advantages compared to the comparative examples: the desired fiaxability to textiles was achieved, it was possible to efficiently remove unused disperse dyes within a short washing time, resulting in excellent washing properties, and sludge formation during washing was minimal.

Example 2

By employing Evaluation Sample B2 (Ink M1 and Pretreatment Solution 3 (at a pH of 4.0)) described in Example 1, the pH of washing solutions was changed as described in Table 6, and washing properties were evaluated employing the same method described in Example 1. Table 6 shows the results. The washing solution was prepared by dissolving HIGH CLEANER CA-10Y, produced by Tokai Seiyu Co. in an amount of 2 g/liter in city water, and the pH was controlled to the value described in Table 6, employing sodium hydroxide or sulfuric acid.

TABLE 6

| pH of Washing Solution | Relative Absorbance Washing Time of Washing Process 1 | | |
|---|---|---|---|
| | 5 minutes | 10 minutes | 20 minutes |
| 3.8 | 110 | 105 | 100 |
| 5.0 | 105 | 100 | 100 |
| 6.0 | 100 | 100 | 100 |

As can clearly be seen from the results described in Table 6, by controlling the pH of the washing solutions during the washing process to be higher than the pH of the pretreatment solution, washing properties were further improved.

Example 3

Inks M7-M9 were prepared in the same manner as Ink M1 described in Example 1, except that each of the disperse dye dispersions described in Table 7 was employed.

Subsequently, Evaluation Samples D1-D3 were prepared in the same manner as Evaluation Sample B1 (Ink M1 and Pretreatment Solution 3) described in Example 1, except that Ink M1 was replaced with each of Inks M7-M9. Based on the evaluation method of washing properties described in Example 1, 60-minute washing process was conducted only employing Washing Process 2.

Subsequently, the washing solution was sampled and the dyes incorporated in the washing solution was extracted employing ethyl acetate. Thereafter, $Absorbance_1$ was determined employing a spectrophotometer UVIDFC-610, produced by Shimadzu Corp. Further, $Absorbance_2$ of the entire ink applied to textiles was determined, and a degree of exhaustion (percent) to the textile was obtained based on the formula below. Table 7 shows the results.

TABLE 7

Degree of exhaustion to textile = $(Absorbance_2 - Absorbance_1)/Absorbance_2 \times 100$ (percent)

| Evaluation Sample No. | Ink | | | | | Pre-treatment Solution No. | Degree of Exhaustion to Textile (%) |
|---|---|---|---|---|---|---|---|
| | Disperse Dye | | | | | | |
| | No. | Type | Melting Point (° C.) | Dispersing Agent | pH | | |
| D1 | D1 | Disperse Yellow 3 | 269 | VANILEX RN | 8.0 | 3 | 65 |
| D2 | D2 | Disperse Orange 11 | 205 | VANILEX RN | 8.0 | 3 | 71 |
| D3 | D3 | Disperse Violet 26 | 193 | VANILEX RN | 8.0 | 3 | 93 |

As can clearly be seen from the results in Table 7, the use of the ink incorporating a disperse dye at a melting point of at most 200° C. increased the degree of exhaustion to the textile.

What is claimed is:

1. A method of forming an ink-jet image comprising the steps in the sequence set forth:

applying a pre-treatment solution to a textile; and ejecting droplets of an ink-jet ink on the textile through an ink-jet head, wherein the ink-jet ink comprises a disperse dye having a melting point of not more than 200° C., a dispersing agent having a carboxyl group in the molecule, water and a water-soluble organic solvent;

the pre-treatment solution comprises an organic acid and does not contain a colorant;

a pH value of the pre-treatment solution is smaller than a pH value of the ink-jet ink;

the pH value of the pre-treatment solution is smaller than a pKa value of the organic acid; and the pKa value of the organic acid is smaller than the pH value of the ink-jet ink.

2. The method of forming an ink-jet image of claim 1, wherein the pH value of the ink-jet ink is larger than a pKa value of the dispersing agent.

3. The method of forming an ink-jet image of claim 1, wherein a molar ratio of the carboxyl group is not less than 50 mol % based on the total mol number of acid dissociation groups in the dispersing agent.

4. The method of forming an ink-jet image of claim 3, wherein a molar ratio of the carboxyl group is not less than 80 mol % based on the total mol number of acid dissociation groups in the dispersing agent.

5. The method of forming an ink-jet image of claim 1, wherein the pKa value of the organic acid is smaller than a pKa value of the dispersing agent in the ink-jet ink.

6. The method of forming an ink-jet image of claim 1, wherein the organic acid is selected from the group consisting of tartaric acid and lactic acid.

7. The method of forming an ink-jet image of claim 1, further comprising the step of:

washing the textile with a washing solution after the ejecting step of the droplets of the ink-jet ink, wherein a pH value of the washing solution is larger than the pH value of the pre-treatment solution.

8. The method of forming an ink-jet image of claim 1, wherein the applying step of the pre-treatment solution is carried out using an ink-jet head.

9. The method of forming an ink-jet image of claim 1, wherein the organic acid in the pre-treatment solution comprises at least one acid selected from the group consisting of formic acid, acetic acid, propionic acid, butyric acid, isobutyric acid, valeric acid, isovaleric acid, oxalic acid, malonic acid, succinic acid, glutaric acid, maleic acid, fumaric acid, citraconic acid, itaconic acid, tricarballylic acid, glycolic acid, thioglycolic acid, lactic acid, malic acid, tartaric acid, citric acid, isocitric acid, gluconic acid, pyruvic acid, oxalacetic acid, diglycolic acid, benzoic acid, phthalic acid, mandelic acid and salicylic acid.

* * * * *